US005262132A

United States Patent [19]

Bricker et al.

[11] Patent Number: 5,262,132

[45] Date of Patent: Nov. 16, 1993

[54] SOLID DETERGENT DISPENSING SYSTEM

[75] Inventors: James C. Bricker, Waynesville; Robert E. Ebbeler, Cincinnati; Michael R. Roseman, Springdale, all of Ohio

[73] Assignee: Diversey Corporation, Mississauga, Canada

[21] Appl. No.: 951,039

[22] Filed: Sep. 24, 1992

Related U.S. Application Data

[63] Continuation of Ser. No. 744,681, Aug. 9, 1991, abandoned, which is a continuation of Ser. No. 516,285, Apr. 30, 1990, abandoned.

[51] Int. Cl.[5] ..... D06F 39/02

[52] U.S. Cl. ..... 422/263; 422/264; 422/266; 422/278; 422/282; 137/268; 134/93; 68/17 R; 222/651

[58] Field of Search ..... 422/263, 264, 266, 282, 422/278; 137/268; 134/93; 68/17 R; 222/651

[56] References Cited

U.S. PATENT DOCUMENTS

| | | | |
|---|---|---|---|
| 2,537,790 | 1/1951 | Sage | 422/263 |
| 2,686,080 | 8/1954 | Wood | 137/1 |
| 3,162,427 | 12/1964 | Knudson et al. | 68/17 R X |
| 3,178,915 | 4/1965 | Hertel | 68/17 R |
| 3,975,931 | 8/1976 | Bischkopf | 68/17 R |
| 4,253,842 | 3/1981 | Ehrlich | 68/17 R X |
| 4,353,876 | 10/1982 | Ballu et al. | 422/266 X |
| 4,462,511 | 7/1984 | Fulmer et al. | 222/52 |
| 4,711,103 | 12/1987 | Mori et al. | 68/12 R |
| 4,774,014 | 9/1988 | Kuenzel et al. | 252/90 |
| 4,836,229 | 6/1989 | Lakhan et al. | 134/93 |

FOREIGN PATENT DOCUMENTS

| | | |
|---|---|---|
| 0300819 | 7/1987 | European Pat. Off. . |
| WO8001160 | 6/1980 | PCT Int'l Appl. . |
| 2226233 | 6/1990 | United Kingdom . |

*Primary Examiner*—Robert J. Warden
*Assistant Examiner*—T. A. Trembley
*Attorney, Agent, or Firm*—Wood, Herron & Evans

[57] ABSTRACT

An apparatus for dispensing solid or semi-solid detergents includes a hollow elongated opening or chute and an arcuate plate that extends from the side wall of the apparatus to beneath the chute. This plate provides a planar support for a detergent bar placed within the chute. Water is sprayed down the arcuate plate and projects against the detergent supported on the planar support causing it to dissolve and flow down a drain. The chute has a unique geometric design which is suitable to receive only one uniquely shaped elongated detergent bar. In a kitchen having several detergent dispensers, each detergent dispenser will have a uniquely defined chute so that only the appropriate detergent can be used in the appropriate dispenser.

2 Claims, 1 Drawing Sheet

SOLID DETERGENT DISPENSING SYSTEM

This application is a continuation of application Ser. No. 744,681, filed Aug. 9, 1991, now abandoned, which is a continuation of application Ser. No. 516,285, filed Apr. 30, 1990, now abandoned.

BACKGROUND OF THE INVENTION

In an institutional kitchen such as a restaurant or cafeteria, there are typically a variety of different mechanical warewashing machines which have unique functions. For example, one machine or one portion of a machine may be particularly designed to presoak dirty dishes. A second machine might be designed to wash the presoaked dishes. Another machine might be designed to scrub pots and pans and an additional machine might be designed to wash glassware. Generally, each machine will use a unique detergent particularly formulated to perform that unique washing function. Institutional laundries are similar.

If the wrong detergent is used in the wrong machine, many problems can occur. One problem might be that the composition will simply be ineffective. Another problem could be that the detergent composition might leave spots on glasses. Another problem would be that an excessively caustic detergent composition in the wrong machine.

With detergent compositions which are held in a container, this problem can be reduced to a certain extent by providing some uniquely shaped container adapted to fit only in a particular dispenser. But this requires a unique container and dispenser for each application. These can also be confusing to an individual who operates a dishwashing machine since it may not be readily apparent which detergent to use with which machine.

SUMMARY OF THE INVENTION

The present invention is premised upon the realization that the above problems can be overcome by using a dispensing system which incorporates a plurality of different dispensers all designed to project water against a solid or semi-solid detergent to dissolve the detergent. The different dispensers will each have a uniquely shaped opening and chute which will permit only a particular shape of detergent composition to be placed into the opening. Thus, a presoak will have a defined geometric shape and a pot and pan scrubber will have a different but unique geometric shape so that neither can be placed in the wrong dispenser.

The different dispensers used can be identical except for the shape of the chute. Thus, the same tooling can be used to make different dispensers. Only the tooling for the chute need by changed.

The invention will be further appreciated in light of the following detailed description and drawings in which.

DETAILED DESCRIPTION

The present invention is described with respect to a kitchen. However it should be understood that this invention applies equally to laundry facilities where there are multiple clothes washing machines as opposed to dishwashing machines or apparatuses.

Figure 1:
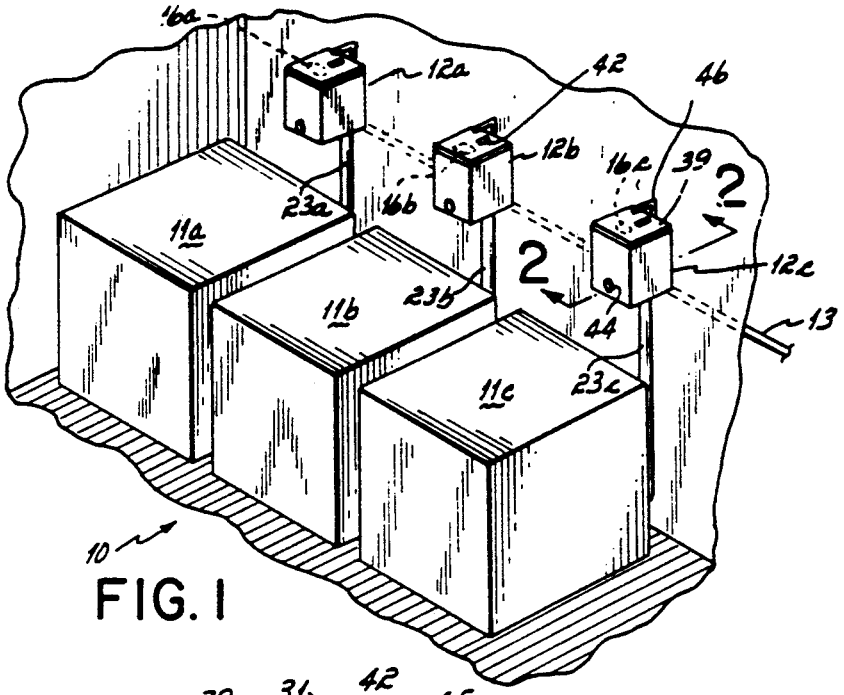
FIG. 1 is a diagrammatic depiction of the kitchen employing multiple dispensers according to the present invention.

As shown in FIG. 1, a kitchen area 10, equipped with a plurality of washers 11*a*, 11*b* and 11*c* connected to detergent dispensers 12*a*, 12*b* and 12*c* via drains 23*a*, 23*b*, and 23*c*. The detergent dispenser 12 of the present invention is shown more particularly in FIG. 2. It includes a chute 16 adapted to receive a long bar of detergent 18 which will be resting on a support 17. Between the support 17 and the chute 16 is a small gap 19 which exposes a bottom portion 21 of the detergent bar 18. A stream 22 of water is impelled against this bottom portion 21 of the detergent bar 18 dissolving it. The dissolved water is directed to drain 23.

More particularly, the detergent dispenser 12 includes a front wall 24, back wall 25 and two side walls 26 and 27. Inside the detergent dispenser 12 is a water slide 28. Water slide 28 is bonded to the side walls 26 and 27 holding it in position. Water slide 28 includes a vertical portion 29 which generally slopes away from the back wall 25. The vertical sloped portion continues to slope until it turns into the support 17. The support 17 is simply the horizontal planar portion of water slide 28.

A first water inlet 31 is directed against the sloped vertical portion 29 of water slide 28 so that water sprayed from the inlet forms the stream 22 of water.

The water slide extends beneath the chute 16 and has a forwardmost edge 32 which is spaced from the front wall 24 providing a gap 33 between the water slide and the front wall.

Beneath the water slide is the bottom wall 34 of the dispenser 12. This is a sloped bottom wall that will direct water passing down slide 28 and through the gap 33 to the drain 23.

The chute 16 is relatively interchangeable. Thus different dispensers can be identical except for the uniquely shaped chute. The chute includes a planar top wall 35 and a horizontal circumferential chute wall 36 which extends down from the top wall 35. An opening 37 extends through the top planar surface into the chute 16 which is open at its bottom. Top wall 35 rests on ledge 38 which extends completely around the four walls of the apparatus 12.

The dispensing apparatus 12 also includes a top cover 39 which covers chute 16. This is connected to the back wall at hinge 41. The top 39 and the top wall 35 of chute 16 also include slots or small openings 42 and 49 respectively adapted to permit water sprays to enter the detergent apparatus.

Figure 2:
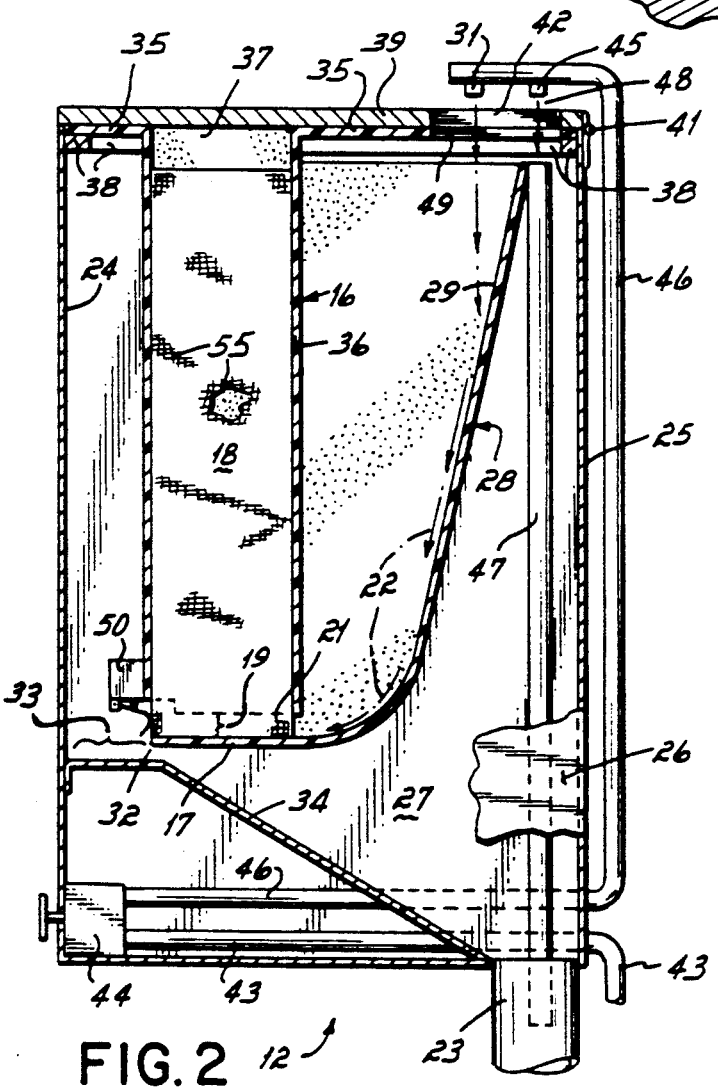
FIG. 2 is a cross sectional view of the present invention taken at lines 2—2 of FIG. 1.

As shown in FIG. 2, the dispenser 12 includes a water inlet 43, connectable with supply line 13, which extends to an on/off valve 44. As shown, the valve 44 connects to first water spray 31 and second water spray 45 via tubing 46. The orifice size of sprays 31 and 45 are provided so that about 20 to 100% of the water passes through spray 31 and acts to dissolve detergent. The water passing from spray 45 goes directly into tube 47.

The space 48 between the spray 45 and tube 47 should eliminate the need for any siphon break. Tube 47 leads to drain 23 acting as a drain assist and sucking in dissolved detergent and foam. Since drain 23 is larger in diameter than tube 47, dissolved detergent passes freely down drain 23 to the respective working apparatus.

In operation, the top cover 39 of the dispenser is lifted and a bar of detergent is dropped into the opening 37 of chute 16. As shown in FIG. 1 and FIGS. 3A-3C, the detergent bar has a cross sectional configuration which corresponds to the cross sectional configuration of opening 37 of chute 16. The detergent bar drops through the chute 16 and rests on the support 17 which is the horizontal portion of the water slide 28. Valve 44 is opened and water from inlet 43 flows through up tube 46 to sprays 31 and 45. A first water supply flows through spray 31. This directs water down the water slide 28 against its sloped vertical portion 29. As this water flows down, it widens out in a fan-shaped pattern or a sheet of water. This sheet of water impinges against the bar of detergent 18 at the exposed bottom portion 21. This dissolves the exposed portion 21 of the detergent bar. In turn, the dissolved detergent passes beyond the water slide and down to the bottom wall 34 to the drain 23. This is then mixed in drain 23 with the second stream of water which flowed from spray 45 down tube 4 into drain 23.

As shown in the FIG. 2, chute 16 includes an optional pressure switch 50 which is adapted to sense the presence of a detergent bar within the chute 16. This can be connected to a warning light which would tell an operator to insert an additional bar of detergent into the chute 16.

One of the primary benefits of the present invention is the ability to use basically the same dispenser for different detergents without significant modification of the dispenser. Thus, one mold can be used to form a large portion of the dispenser. Only the chute need be different to make the dispenser suitable for use only with the appropriate detergent.

Figure 3A:
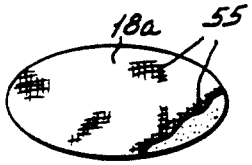
FIG. 3A is a top view partially broken away of one embodiment of a detergent block for use in the present invention.
Figure 3B:
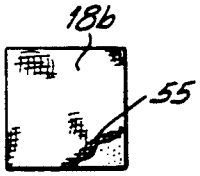
FIG. 3B is a top view of a perspective view of an alternate embodiment of the detergent block for use in the present invention.
Figure 3C:
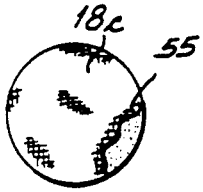
FIG. 3C is a top view of a second alternate embodiment of a detergent block for use in the present invention.

As shown in FIGS. 3A-3C, the detergent bars each having unique chemical compositions will also have unique shapes. Three are shown but there can be as many as required. Thus, the dishwashing detergent **18*a* which is formulated for use as a pot and pan scrubber might have an oval shape as shown in FIG. 3A and be inserted in dispensers 12*a*. The detergent 18*b* which is used to wash plates and the like and having a composition especially adapted for that application might have a square cross-sectional configuration as shown in FIG. 3B and be inserted in dispensers 12*b*. The detergent composition 18*c* which is used to wash silverware might have a cylindrical configuration as shown in FIG. 3C and be inserted in dispensers 12*c***.

As seen in FIG. 1, a kitchen using a plurality of detergents dispensers would have a dispenser for each of these detergents. More particularly, each one of these dispensers would have a chute corresponding in shape to the shape of the detergent 3A-3C. Thus the dispenser for the pot and pan scrubber would have an oval shaped chute. This would prevent the operator from inserting round or square detergent bars.

Any solid detergent formulation can be used as part of the present invention. A suitable detergent formulation is disclosed in Bruegge application "Method of Making Paste Detergent and Product Produced," Ser. No. 476,297, filed Feb. 7, 1990, and is hereby incorporated by reference.

As an added feature of the present invention, the detergent compositions **18*a*, 18*b* and 18*c* will preferably be covered in a water soluble wrapper 55 as shown more particularly in FIG. 2 and FIGS. 3A-3C. Such material is sold by CMS Gilbreath under brand name dissolvo pouching DP45. To further facilitate use of the appropriate detergent in the appropriate dispenser, the top 39 of the dispenser can be color coded for the particular detergent. Thus, the oval detergent which is adapted to be used to wash pots and pans, and be used only in an oval chute, might have a green wrapper. The top 39** of the dispenser for the pot and pan scrubber likewise would be green.

Likewise, the detergent bar formulated for washing dishes, which is square in shape, might have a blue water soluble wrapper. The top of the dispenser covering the square chute for the dishwashing machine dispenser would likewise be blue and so on.

In a kitchen which would include two, three or more dispensers, this provides many unique advantages. The color coating quickly tells an operator what detergent to be used in what dispenser. Since the chutes have a cross sectional configuration which must correspond to the cross sectional configuration of the detergent bar, it is almost impossible to use the wrong detergent in the wrong dispenser.

With smaller tablets, it is possible to force fit the wrong detergent into the wrong dispenser. But with an elongated bar such as this, it is almost impossible to force fit the bar into the detergent dispenser. Since this is a gravity feed dispenser, if the wrong detergent was force fitted into the dispenser, it would not continue to fall down the dispenser where it would be contacted with a lateral spray of water.

The dispenser of the present invention provides many safety features. Since the spray of water is lateral, it is very unlikely that it is going to spray out of the dispenser from the top. Since an elongated chute is used this possibility is then again reduced. The water would simply have to go too far up the dispenser chute to spray out the top.

Since the lateral spray of water is very focused against a relatively small portion of the detergent bar, the possibility of chunks of detergent bar breaking off and falling into the drain, clogging the drain, is substantially reduced. This is a significant improvement over dispensers which spray upwardly against a tub of detergent.

Further, due to the fact that a water soluble wrapper is employed, there is no container to dispose. This substantially reduces the need to dispose of plastic containers which generally are not biodegradable. This also eliminates the problem of the need to rinse spent containers.

And finally, an extremely significant feature of this invention, it allows almost identical apparatuses to be employed to dispense multiple detergents. Only one piece of each dispenser would be different. This substantially reduces the costs of manufacturing the various dispensers.

Thus, the present invention provides a multitude of different advantages which aid the user of the dispenser as well as the manufacturer of the dispenser.

The preceding has been a description of the present invention and the preferred method currently known of practicing the invention.

However, the invention should be defined only by the appended claims wherein we claim:

1. In combination an elongate solid detergent bar and an apparatus for dissolving said elongated solid detergent bar and dispensing dissolved detergent said combination comprising: an outer wall, an elongated chute spaced from said outer wall and having an open top and an open bottom and having a cross-sectional configuration;

a planar support beneath said elongated chute spaced from said open bottom providing a gap of a predetermined height between said elongated chute and said planar support;

a solid detergent bar having a cross-sectional configuration substantially the same as the cross-sectional configuration of said elongated chute, said solid detergent bar resting in said elongated chute supported by said planar support whereby only a lower cross-sectional portion of said solid detergent bar is exposed at said gap, said lower cross-sectional portion having a thickness equal to said predetermined height;

means to project water at said gap and drain beyond said gap;

whereby said exposed portion of said solid detergent bar at said gap is dissolved by water projected at said gap and as said exposed portion is dissolved and removed by water flowing toward said drain, fresh solid detergent bar advances into said gap to provide a new lower cross-sectional portion of said solid detergent bar.

2. The combination claimed in claim 1 wherein said elongated chute supports a sensor capable of detecting the presence of said solid lower cross-sectional portion of said solid detergent bar in said elongated chute.

* * * * *